United States Patent [19]

Wood

[11] 4,403,374

[45] Sep. 13, 1983

[54] MEANS FOR CONTROLLING DENSITY OF NON-WOVEN FIBER WEBS

[75] Inventor: Dennis E. Wood, Fairport, N.Y.

[73] Assignee: Rando Machine Corporation, Macedon, N.Y.

[21] Appl. No.: 274,521

[22] Filed: Jun. 17, 1981

[51] Int. Cl.[3] ..... D01G 15/40

[52] U.S. Cl. ..... 19/105; 19/240; 222/55; 406/171

[58] Field of Search ..... 19/105, 240, 300–308, 19/296, 297, 298, 299; 222/55; 406/171

[56] References Cited

U.S. PATENT DOCUMENTS

| | | | |
|---|---|---|---|
| 3,474,501 | 10/1969 | Jeanmaire | 19/105 |
| 3,709,406 | 1/1973 | Binder | 19/105 X |
| 4,030,635 | 6/1977 | Hablützel et al. | 19/105 X |
| 4,176,988 | 12/1979 | Lattmann | 19/105 X |
| 4,240,180 | 12/1980 | Wood et al. | 19/105 |
| 4,353,148 | 10/1982 | Beneke | 19/105 |

*Primary Examiner*—Louis Rimrodt

*Attorney, Agent, or Firm*—Shlesinger, Fitzsimmons & Shlesinger

[57] ABSTRACT

A vertical feed chute includes a feed roll for feeding fibers from a surge section in its upper end to a formation section in its lower end. A stationary, perforated condenser plate is secured to the lower, discharge end of the chute, and has thereon a concave surface which extends beneath the chute discharge opening, and beneath a metering roll that is mounted to rotate in the discharge opening in confronting relation to the condenser plate. A mat of fibers is drawn from the discharge opening into a nip between the condenser plate and metering roll where the mat is compressed and then fed to the input of a carding machine, or the like. The metering roll is mounted for limited reciprocable movement normal to its axis, and toward and away from the concave condenser surface. In one embodiment the roll is positively driven by pneumatic means toward or away from the concave surface depending upon the density of the mat entering the nip. In another embodiment the metering roll is mounted to reciprocate in response to changes in the thickness of the mat; and this movement is used either to increase or decrease the rate at which fibers are fed to the formation section of the chute, thereby to effect a corresponding increase or decrease in the thickness of the mat.

9 Claims, 3 Drawing Figures

MEANS FOR CONTROLLING DENSITY OF NON-WOVEN FIBER WEBS

BACKGROUND OF THE INVENTION

This invention relates to the production of non-woven fiber webs, and more particularly to improved means for controlling the density of such webs. Even more particularly this invention relates to an improved web-forming condenser, and means for controlling the fiber web or mat formed thereby.

It is conventional to employ pneumatically-operated systems for supplying air-borne fibers to the feed chutes for carding machines and the like. As shown for example in U.S. Pat. No. 4,240,180, a vertically-disposed feed chute collects fibers from an overhead, pneumatic fiber supply system, and then forms the fibers into a continuous, non-woven fiber mat or web, which is fed from the lower end of the chute to the input of a carding machine. As disclosed in that particular patent, fibers are collected in the upper or surge section of the chute, and are fed by one or more feed rolls onto an opening roll, which rotates about a horizontal axis intermediate the ends of the chute. The opening roll feeds the fibers downwardly to a formation section of the chute, from where they pass onto the perforated surface of a condenser drum that rotates at the lower end of the chute to form a continuous fibrous mat or web which is fed to the associated carding machine.

With this type of apparatus it is particularly desirable to be able to control the uniformity and density of the mat or web produced at the lower end of the feed chute. As taught in the above-noted U.S. Pat. No. 4,240,180, one such control is effected by varying the speed of rotation of the feed rolls, so that the quantities of fibers fed thereby to the formation section of the chute will be increased or decreased, as necessary, in order to effect a corresponding increase or decrease in the density of the web produced at the output of the chute.

Although web density thus can be controlled by varying the rate at which fibers are fed to a condenser, it is desirable to provide means for producing a more responsive control of the web density—i.e., means which can effect a more instantaneous change in the density of the web that is being formed at the output of a fiber supply chute.

It is an object of this invention, therefore, to provide improved means for rapidly and accurately controlling the density of a web produced at the output of a fiber supply chute of the type described.

Another object of this invention is to provide improved means for sensing the density of a fiber web formed on a condenser at the output of a feed chute of the type described, and for effecting almost instantaneous changes in the density of the web to conform to a predetermined desired density.

A more specific object of this invention is to provide an improved type of condenser for use at the output of a feed chute of the type described, and associated means for mechanically compacting the web, as required, to provide a web of uniform, predetermined density.

SUMMARY OF THE INVENTION

This invention involves the use of a novel, stationary condenser which is fixed to the lower end of a vertical fiber feed chute for the purpose of forming and feeding a non-woven fiber web to the input of a carding machine or the like. The novel condenser is in the form of a perforated, curved plate having thereon a concave, mat-forming surface disposed in confronting relation with a metering roll, which is mounted for rotation about a horizontal axis adjacent the condenser. The mat, which is formed on the condenser, passes beneath the metering roll, which is journaled at opposite ends in adjustable bearings that are mounted for linear reciprocation toward or away from the concave, mat-forming surface of the condenser.

In one embodiment the metering roll is moved positively toward or away from the condenser surface in response to a control mechanism which monitors the density of the web that is produced by the condenser, so that the density of the web is almost instantly increased or decreased, depending upon whether the metering roll is urged toward or away from the adjacent condenser surface. In another embodiment the metering roll is resiliently urged toward the condenser plate so that changes in the thickness of the mat that is formed beneath the roll will cause a corresponding reciprocation of the roll-supporting bearings toward or away from the condenser plate. This movement of the metering roll is sensed by an LVDT, which produces an electrical signal for controlling the motor for the associated feed roll in the chute, thereby to control the mat density.

THE DRAWINGS

DETAILED DESCRIPTION OF THE INVENTION

Figure 1:
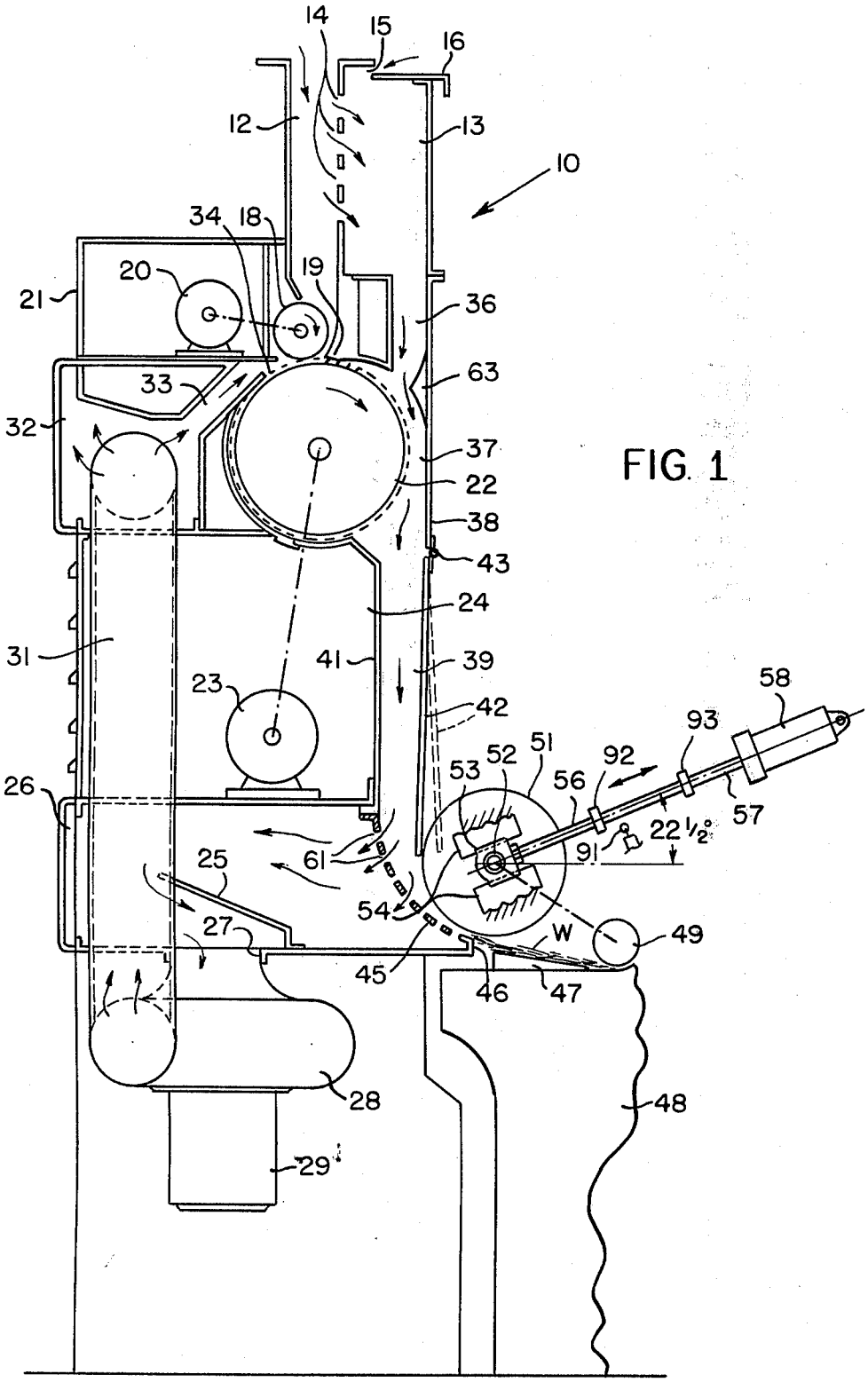
FIG. 1 is a schematic or fragmentary side elevational view of a fiber supply duct made according to one embodiment of this invention, and illustrating in cross section a novel condenser employed with this apparatus.
Figure 2:
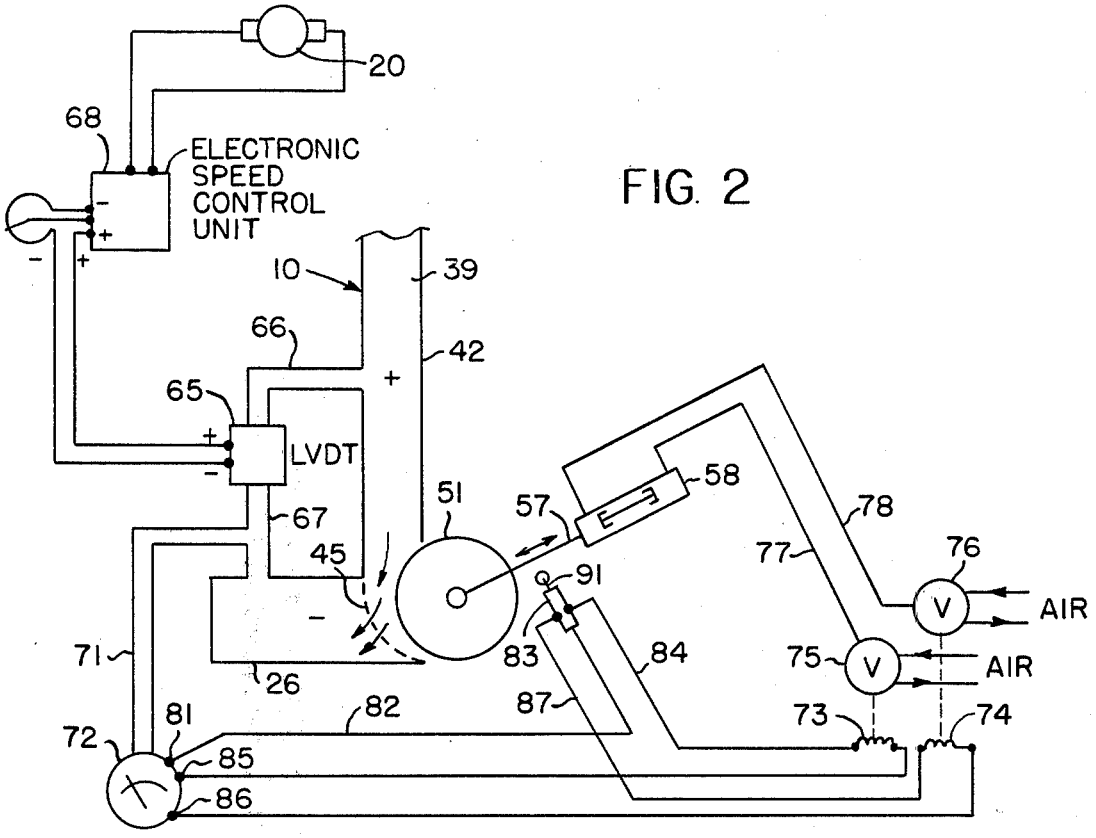
FIG. 2 is a combination wiring diagram and schematic drawing showing one form of electro-mechanical means for controlling the density of the mat produced on the condenser shown in FIG. 1.

Referring now to the drawings by numerals of reference, and first to FIGS. 1 and 2, 10 denotes generally a novel fiber supply chute having in its upper end the usual surge section 12 to which fibers are adapted to be supplied by a conventional, overhead, pneumatic fiber supply system (not illustrated). Mounted on chute 10 at one side of the surge section 12 is a re-entrant duct 13, which communicates with section 12 through a plurality of ports or openings 14 formed in the wall of the chute that separates section 12 from chamber 13. An opening 15 in the upper end of duct 13 is covered by a manually-adjustable cover plate or damper 16 for purposes noted hereinafter.

A feed roll 18, which is mounted to rotate in the lower, open end of the surge section 12 adjacent a conventional nose bar 19, is driven by a variable speed electric motor 20, which is mounted in a chamber 21 formed on the chute adjacent the surge section 12. Feed roll 18 draws fibers from the bottom of surge section 12 and feeds them downwardly onto a large opening roll 22 of conventional design, which is mounted for rotation about a horizontal axis beneath and in parallel to the feed roll 18. The opening roll 22 is driven by an electric motor 23, which is mounted in chamber 24 beneath the opening roll, and above a vacuum box or expansion chamber 26, which is formed on the lower end of chute 10 adjacent one side thereof.

Secured to the underside of chamber 26 with its inlet end 27 opening on the interior of the chamber beneath a baffle 25, is a low capacity fan 28, which is driven by an electric motor 29. Fan 28, which may have a capacity of from 200 to 450 CFM, has its discharge opening connected by a vertical duct 31 to another expansion chamber 32, which is formed at one side of chute 10 beneath the motor chamber 21. Chamber 32 communicates through a duct or passageway 33 with an elongate air discharge slot 34, which confronts the nip formed between the feed roll 18 and the opening roll 22.

The re-entrant duct 13 has in its lower end a narrow opening 36, which registers vertically with another narrow opening or doffing space 37 that is formed in chute 10 adjacent one side (the right side of FIG. 1) of the opening roll 22, between this roll and a fixed or stationary section 38 of the chute. Spaces 36 and 37 also register vertically with the formation section 39, which is formed in the lower end of chute 10 beneath the doffing side of opening roll 22.

The formation section 39 comprises a stationary, vertically disposed inside wall 41, which separates section 39 from the chamber 24, and a movable or pivotal outside wall 42, which is hingedly connected along its upper edge as at 43 to the lower edge of the stationary chute wall 38. The lower end of formation section 39 opens onto the concave, upper surface of a stationary, perforated, curved plate or condenser 45, which forms one sidewall (the right hand sidewall as shown in FIG. 1) of the vacuum box 26. Condenser 45, which extends the entire width of chute 10, is fixed along its upper edge to the lower edge of the stationary chute wall 41, and curves downwardly and outwardly beneath the lower edge of the pivotal chute wall 42. The lower, discharge edge 46 of plate 45 registers with a web guide plate 47, which is formed on the upper surface of a conventional carding machine 48, or the like, for the purpose of directing a non-woven fiberous mat or web W into the lickerin 49 for the carding machine.

Figure 3:
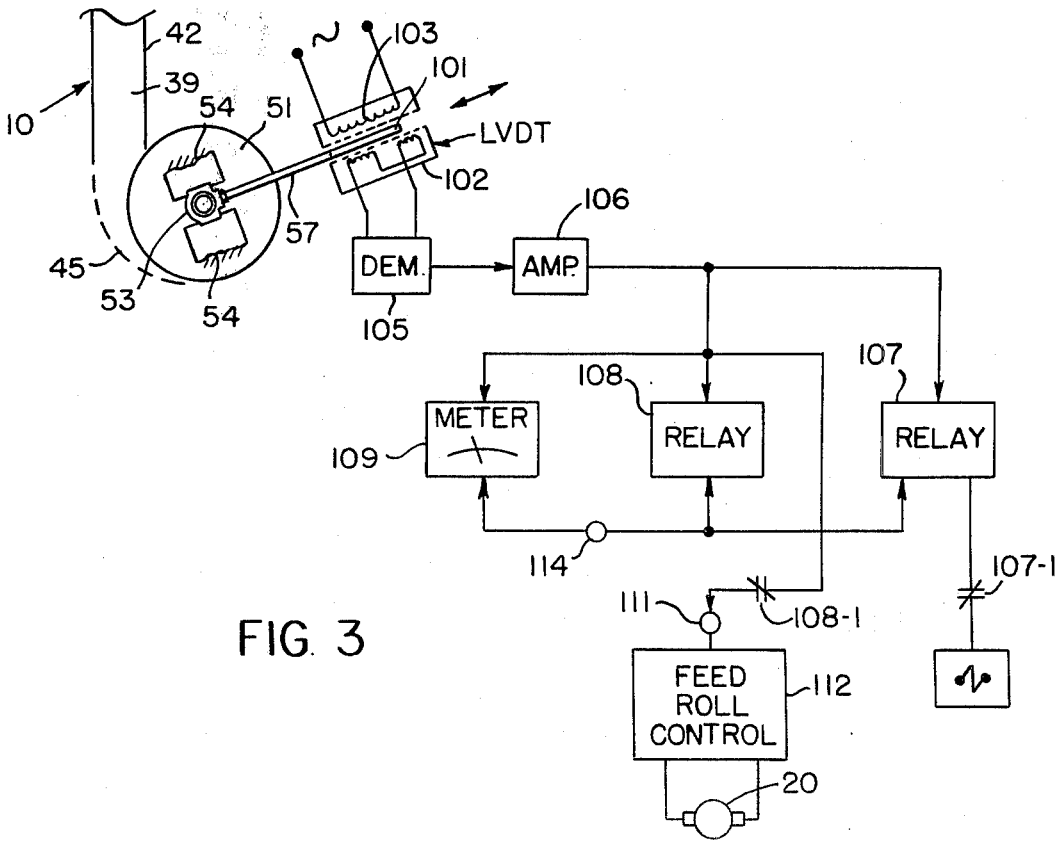
FIG. 3 is a combination wiring diagram and schematic showing still another form of control means for this invention.

Mounted for rotation about a horizontal axis in confronting relation to the perforated condenser 45 and the lower edge of the pivotal chute wall 42, is a rotary metering roll 51. The metering roll shaft 52 has opposite ends thereof rotatably journaled in a pair of identical slide blocks or bearings 53, only one of which is shown in FIGS. 1 and 3. Each bearing block 53 is mounted for reciprocation between a pair of spaced, stationary guide blocks 54, which project slidably into registering grooves or ways formed in opposite sides of each bearing block 53. The blocks 54 are fixed to the frame of chute 10 to guide shaft 52, and hence the metering roll 51, for limited reciprocable movement in a plane which extends parallel to the axis of the opening roll 22, and which is inclined, by way of example, at approximately 22½ degrees to the horizontal. The reciprocable bearing blocks 53 are connected by a yoke 56, or the like, to a reciprocable piston rod extension 57, which is connected to the piston of a conventional air cylinder 58 for reciprocation thereby. Cylinder 58 is fixed at any convenient spot on the frame of chute 10.

In practice the shaft 52 of the metering roll 51, and hence the metering roll itself, may be driven by a variable speed electric motor, or it may be driven by a suitable chain and sprocket drive (not illustrated) from the lickerin 49 of the carding machine 48.

In operation, the fan 28 creates a vacuum in chamber 26 so that the incoming air, which conveys fibers to the surge chute 12, passes through the openings 14 in the inside wall of chamber 13, then downwardly through the registering openings 36 and 37 to the formation chamber 39. The air then passes through the column of fibers that is collected in this chamber, and passes through the openings 61 in the stationary condenser plate 45 to the input of the fan 28, which then exhausts air under pressure upwardly through the duct 31, the chamber 32 and passageway 33 to the slot 34. The airflow from this slot assists in the removal of fibers from the pins on the opening roll 22, and helps to force or doff the fibers downwardly into the upper part of the formation duct 39.

To minimize turbulence, and to assist in the control of the air flow downwardly past the doffing section of the opening roll 22, a crowned accelerator plate or quadrant 63 may be adjustably mounted on the inside surface of the chute wall 38 between the spaces 36 and 37 with its apex confronting upon, and extending parallel to the space between the feed roll 18 and the opening roll 22.

The openings 61 in the stationary condenser 45 are small enough so that they permit air to pass therethrough into chamber 26, but at the same time prevent the tufts of fibers in chute 10 from passing into chamber 26. The return of air passing downwardly through the formation section 39, assisted by gravity, helps to keep the fibers moving downwardly beneath the lower edge of the chute wall 42, and into the decreasing, wedge-shaped space (as viewed in cross section) formed by the nip between the concave upper surface of condenser plate 45, and the peripheral surface of metering roll 51. The concave surface of the plate 45 is provided with a low-friction coating, such as "Teflon," while the metering roll 51 is provided with a high-friction surface, such as textured rubber. Consequently, as the mat of fibers passes between the plate 45 and roll 51 it is slightly compressed or densified, and the entrapped air is allowed to escape rearwardly through the openings 61 in plate 45 into the chamber 26. The pressure applied to the mat of fibers as it passes between roll 51 and the curved plate 45 should be just enough to produce the desired compaction or densification of the mat. The metering roll 51 is of a smaller radius than that of the concave surface of plate 45, thus producing the above-noted wedge-shaped nip between the roll and condenser.

One of the advantages of this construction is that the metering roll 51 can be adjusted toward or away from the concave surface of the condenser 45, thus enabling an instant adjustment in the cross sectional area of the mat as it passes between the roll and condenser. Assuming that the feed rate of fibers into the formation section is generally constant, than the density of the mat produced can be made to vary in proportion to the adjustment of the metering roll 51 toward or away from the condenser 45. This, in turn, enables control of the final thickness and/or weight of mat or web W produced at the output of the chute.

One way of adjusting the metering roll 51 to produce a corresponding adjustment in the density of web W is shown in FIG. 2, wherein 65 denotes a conventional pressure transmitter of the linear variable differential transformer (LVDT) type, which may be similar to that disclosed in the above-noted U.S. Pat. No. 4,240,180.

The transmitter includes the usual diaphragm (not illustrated), one side of which communicates through a duct 66 with the formation chamber 39 adjacent its upper end, and the other side of which communicates through another duct 67 with the interior of the vacuum box 26. As a consequence, the transmitter monitors the pressure differential developed across the mat of fibers formed on the condenser 45. Also as in the case of the above-noted patent, the DC signals generated at the output of the transmitter 65 are applied to an electronic speed control unit 68, the output of which is connected to the feed roll motor 20 to vary the speed of feed roll 18 in proportion to the change in the differential pressure detected by the transmitter 65.

The duct 67, and hence the vacuum box 26, are also connected by another duct 71 to a conventional photohelic control device 72, which may be of the type disclosed in U.S. Pat. No. 3,397,319. Device 72 controls a pair of relay coils 73 and 74, which in turn control air valves 75 and 76, respectively. When relay coil 73 is energized, valve 75 supplies compressed air through a line 77 to one end of cylinder 58, while the opposite end thereof exhausts through line 78 and valve 76. Consequently the piston in cylinder 58 advances in order to cause the rod 57 to urge the metering roll 51 toward the condenser plate 45. On the other hand, when the relay coil 74 is energized, valve 76 causes compressed air to be supplied through line 78 to the forward end of the cylinder 58, at which time the rear end of the cylinder is exhausted through line 77 and valve 75. This causes the piston in cylinder 58 to be retracted, thus causing the rod 57 to withdraw the metering roll 51 rearwardly or away from the condenser plate 45.

In practice, whenever the fiber density of the mat formed on the condenser 45 is undesirably low, there will be a relatively low differential pressure and consequently relatively low vacuum in duct 71. When this occurs electrical power from an input terminal 81 on the photohelic device 72 is applied through a line 82 to a common terminal on a limit switch 83, and then through a first pair of normally-closed switch contacts in switch 83 (not illustrated) to line 84, which is connected through the relay coil 73 to another terminal 85 on the device 72. At this time because the pressure in the duct 71 has risen to a point where the vacuum in box 26 is undesirably low, a switch in the photohelic device is closed to complete a connection between terminals 81 and 85, thus energizing coil 73 through the associated, normally-closed switch contacts in the limit switch 83. This operates valve 75 causing the metering roll 51 to be urged toward the condenser plate 45, thereby increasing the density of the mat or web W formed thereon.

On the other hand, if the density of the web that is being formed on the plate 45 becomes too great, or exceeds a predetermined value, the vacuum in box 26 will rise to a point where the remaining terminal 86 on the device 72 becomes connected to terminal 81, thus completing a circuit from terminal 81, through line 82, a second pair of normally-closed switch contacts (not illustrated) in the switch 83, and the line 87 and relay coil 74 to terminal 86, thereby energizing coil 74 and causing valve 76 to operate so that the metering roll is withdrawn, or moved away from the condenser plate 45. This decreases the density of the mat then being formed between the condenser and roll 51.

To provide an absolute limit on the reciprocation on the roll 51, the switch 83 has an operating arm 91 which projects into the space between a pair of axially-spaced collars 92 and 93, which are adjustably mounted (FIG. 1) on the rod 57 selectively to engage the switch arm 91 whenever the roll 51 is advanced too far in either direction. For example, whenever the collar 93 trips the operating arm 91, one of the pair of normally closed switch contacts in switch 83 is opened and deenergizes coil 73 thus to prevent any further advance of the metering roll. On the other hand, if the roll is retracted too far, the collar 92 will strike the switch arm 91 and open the other pair of normally-closed contacts to deenergize relay 74 to prevent further retraction of roll 51.

During the advance and retraction of the metering roll as described above, the pivotal wall 42 of the chute 10 is free also to swing toward and away from the opposite wall 41 of the formation section 39, thereby also contributing the compaction or expansion of the column of fibers located in the formation section.

From the foregoing it will be apparent that the present invention provides relatively simple and inexpensive means for controlling the continunity and density of a fiber web formed at the output of a supply chute of the type described herein. By employing a stationary, perforated condenser plate, not only is the cost of the unit substantially reduced as compared to prior such units, but also the control of the density of the web is simplified, since it is possible almost instantly to vary the pressure exerted on the mat by the metering roll 51 in response to any changes in the differential pressure sensed by the transmitter 65 or the photohelic device 72. In addition, by proper adjustment of the damper plate 16 in the re-entry duct 13, it is possible also to stablize the downward flow of air through the fibers in the chute 10. Also, by recirculating the air from the expansion or vacuum chamber 26 to the nip between the feed roll 18 and the pening roll 22, a more uniform delivery of fibers to the formation chamber 39 can be experienced.

In the embodiment shown in FIG. 3, wherein like numerals are employed to denote elements similar to those employed in the preceding embodiment, the reciprocable operating rod 57 for the metering 51 is connected to the armature 101 of the LVDT unit of the type sold, for example, by Automatic Timing and Controls located in King of Prussia, Pa. or from Schaevitz Engineering of Camden, New Jersey. Each of these units comprises a transformer having a primary coil 103 adapted to receive power from an AC signal supply, and to induce an AC signal in a pair of secondary windings, the output of which is rectified by a demodulator 105, and then applied to an amplifier 106. The DC output signal of the amplifier 106 is applied to one of the inputs of each of the two offset relays 107 and 108, and to one of the inputs of a digital voltmeter (DVM) 109. This same signal is also applied to the potentiometer 111 of a conventional speed control unit 112, which controls the operation of the feed roll motor 20, and which may be of the type disclosed, for example, in U.S. Pat. No. 4,240,180. The offset relays 107 and 108, and the DVM 109 are provided each with a second DC input signal from a set point potentiometer 114.

The signal output of the amplifier 106 is representative of the load that is applied to the metering roll 51 by the feed mat which is formed between the roll 51 and the curved condenser plate 45. For example, assuming that the slide blocks 53, which support the shaft for the metering roll 51, are free to slide or reciprocate between their respective guide blocks in response to changes in the thickness of the web W being formed between the roll 51 and the condenser 45, then a low density mat would allow the metering roll 51 to move closer to the condenser plate 45, while on the other hand, a relatively hight density (thick) mat would cause metering roll 51 to be urged away from the plate 45. Since this reciprocable movement of roll 51 is transmitted by the rod 57 to the armature 101 in the LVDT unit 102, the signal output of this unit, as reflected by the output of the DC amplifier 106, is likewise indicative of, or proportional to, the density of the mat produced between roll 51 and plate 45.

In order to lend some significance to the signal output of amplifier 106 the potentiometer 114 is adjusted to apply to the other input of each of the relays 107, 108 and meter 109, a set, predetermined voltage, which is representative of the desired density of the mat formed beneath roll 51. When the input signal from amplifier 106 to the relay 107 indicates that the density of the mat formed beneath roll 51 is too low, a coil in relay 107 becomes energized and opens, for example, a normally-closed switch 107-1, which interrupts power to the unit and shuts down the entire machine so that the machine is prevented from manufacturing "off spec" materials. On the other hand, when the signal from amplifier 106 corresponds to a mat density which is too great, a coil in relay 108 is energized to open, for example, a normally-closed switch 108-1 which interrupts power to the feed roll control unit 112, so that the motor 20 for the feed roll 18 is shut down until the density of the fabric mat falls back, or is reduced to a value beneath its upper limit. Thereafter the feed roll motor 20 will once again become energized.

The input signals to the meter 109 are compared and produce a composite signal which is representative of the density of the fabric mat at any moment.

With this control system the load on the metering roll 51 can be monitored and used to control the amount of fiber fed into the formation section of the chute by the feed roll 18, and in this way can control the density of the fabric mat produced between roll 51 and the condenser plate 45, as determined by the set point potentiometer 114. The advantage of this system is that it will reduce any long and short term variations in the feed mat, and will produce a more uniform product. This system also overcomes the excess of air flow variance, which might cause differential pressure deviations between the forming duct pressure and the condenser pressure, as may occur when the controls of the preceding embodiment are employed.

In connection with the embodiment shown in FIG. 3, it is to be understood that the manner in which the metering roll 51 is mounted for linear movement can be modified without, departing from this invention. For example, the slide blocks 53 can be mounted to slide between the supporting blocks 54 solely as the result of gravity, or if desired blocks could be spring-loaded in the direction of the condenser 45. In either case, the important factor is that the reciprocable movement of the roll 51 will be sensed by the unit 102, and immediate compensation will be made by adjusting the speed of the feed roll motor 20 as may be necessary to maintain the desired density of the mat formed on the condenser 45.

While this invention has been illustrated and described in connection with only certain embodiments thereof, it will be apparent that it is capable of still further modification, and that this application is intended to cover any such modifications as may fall within the scope of one skilled in the art, or the appended claims.

What I claim is:

1. Apparatus for forming a non-woven fiber mat, comprising a fiber feed chute having in its upper end a surge section for receiving air-borne fibers from a supply thereof, and in its lower end a formation section for forming fibers into a predetermined configuration, means intermediate the ends of said chute for feeding fibers downwardly from said surge section to said formation section, a metering roll mounted to rotate adjacent the lower end of said chute, and for limited reciprocable movement transversely thereof, a stationary condenser mounted beneath an opening in the lower end of said chute and having thereon a concave surface extending beneath said roll to form therewith a nip which communicates with said opening in the chute, said roll being operative during rotation thereof to draw fibers from said chute and to compress them into a non-woven mat as they pass through said nip and between said roll and the concave surface on said condenser, sensing means for monitoring the density of the fiber mat passing between said roll and said condenser, and means for adjusting the density of said mat when said density differs from a predetermined value, said adjusting means including means for positively moving said roll toward said condenser, when said mat density falls below said predetermined value, and to move said roll away from said condenser, when said mat density exceeds said predetermined value.

2. Apparatus as defined in claim 1, wherein the radius of said roll is less than the radius of curvature of said concave surface, and the axis of said roll extends parallel to the axis of said concave surface.

3. Apparatus as defined in claim 1, wherein said concave surface of the condenser is coated with a low friction material, and said metering roll has a relatively high friction surface engageable with said mat.

4. Apparatus as defined in claim 1, wherein said means for moving said roll comprises a cylinder having its piston operatively connected to said roll to impart the reciprocation of said piston to said roll, valve means for selectively feeding fluid under pressure to, and exhausting it from, said cylinder to affect reciprocation of said piston, and electrical control means for operating said valve means and responsive to signals received from said sensing means to cause said valve means selectively to connect opposite ends of said cylinder to a supply of fluid under pressure, thereby selectively to impart reciprocation to said roll.

5. Apparatus as defined in claim 1, wherein said formation section of said chute comprises a pair of spaced, parallel walls one of which is stationary and the other of which is pivotally mounted at its upper edge for swinging movement toward and away from said stationary wall, said metering roll is mounted to rotate adjacent the lower edge of said pivotal wall of the chute, and in confronting relation to said concave surface on said condenser, and said condenser is a curved, perforated plate secured along its upper edge to the lower edge of said stationary wall of the chute, and curving downwardly beneath the lower edge of said pivotal wall of the chute and said roll.

6. Apparatus as defined in claim 5, wherein said fiber feeding means comprises a feed roll mounted to rotate adjacent the lower end of said surge section of said chute and to feed fibers downwardly onto an opening roll mounted in the chute beneath the feed roll, said condenser forms one wall of a vacuum chamber formed adjacent the lower end of said chute, and a fan is mounted with its air intake in communication with said vacuum chamber and its exhaust connected to a discharge opening which confronts on a nip formed between said feed roll and said opening roll.

7. Apparatus for controlling the density of a fiber mat produced by a vertical fiber feed chute, comprising a vertical feed chute for supplying fibers to a discharge opening in the bottom of the chute, a perforated condenser secured to said chute and having thereon a stationary concave surface which extends downwardly beneath said opening, a metering roll mounted to rotate it in said opening about an axis parallel to the axis of curvature of said concave surface, and in spaced, confronting relation to said surface, said roll being operative, when rotating, to draw a continuous fiber mat from said opening, and to cause the mat to pass between said concave surface and the periphery of said roll thereby to compress said mat, means mounting said roll for limited reciprocable movement at right angles to its axis toward, and away from said concave surface, thereby to adjust the distance between said surface and the periphery of said roll, means for sensing at any moment the density of the mat passing between said concave surface and said roll, and control means responsive to said sensing means positively to more said roll in one of the two directions in which it reciprocates, when the density of said mat differs from a predetermined value.

8. Apparatus as defined in claim 7, wherein said sensing means includes means for generating an electrical signal proportionate to the density of said mat, and said control means includes means operative when the voltage of said signal exceeds a preset value to shift said roll in said one direction, and to shift said roll in the opposite direction, when said voltage falls below said preset value.

9. Apparatus as defined in claim 7, wherein said perforated condenser comprises a curved plate forming one wall of a vacuum chamber located adjacent the lower end of said chute, and a fan has an inlet connected to said chamber and an outlet communicating with the upper end of said chute and is operative to draw air from said chamber and to discharge said air into the upper end of said chute.

* * * * *